US009480996B2

(12) United States Patent
Reiland et al.

(10) Patent No.: US 9,480,996 B2
(45) Date of Patent: Nov. 1, 2016

(54) FLUID DISPENSING SYSTEM WITH NOZZLE HEATER

(71) Applicant: Illinois Tool Works Inc., Glenview, IL (US)

(72) Inventors: Douglas H. Reiland, Hendersonville, TN (US); Larry W. Flatt, Hendersonville, TN (US); Paul M. Jenkins, Hendersonville, TN (US)

(73) Assignee: Ilinois Tool Works Inc., Glenview, IL (US)

( * ) Notice: Subject to any disclaimer, the term of this patent is extended or adjusted under 35 U.S.C. 154(b) by 32 days.

(21) Appl. No.: 13/946,766

(22) Filed: Jul. 19, 2013

(65) Prior Publication Data

US 2014/0076931 A1 Mar. 20, 2014

Related U.S. Application Data

(60) Provisional application No. 61/702,565, filed on Sep. 18, 2012.

(51) Int. Cl.
*B67D 7/80* (2010.01)
*B05B 7/16* (2006.01)
(Continued)

(52) U.S. Cl.
CPC ..... *B05B 7/1693* (2013.01); *B05B 7/1606* (2013.01); *B05C 5/001* (2013.01); *B05C 5/02* (2013.01); *B05C 5/027* (2013.01);
(Continued)

(58) Field of Classification Search
CPC ... B05B 7/1613; B05B 7/164; B05B 7/1693; B05B 7/1606; B05B 15/02; D01D 5/0985; B27G 11/02; B05C 5/001; B05C 5/02; B05C 5/027; B05C 5/0283; B05C 9/06; B05C 11/1042
USPC ..... 222/146.2–146.5; 239/135, 138
See application file for complete search history.

(56) References Cited

U.S. PATENT DOCUMENTS 3,408,008 A * 10/1968 Cocks ..... B05C 5/001 219/230
3,770,201 A * 11/1973 Sanders ..... B05B 7/168 239/135

(Continued)

FOREIGN PATENT DOCUMENTS

EP 0131883 A2 1/1985
EP 1588778 A2 10/2005
EP 1591167 A1 11/2005

OTHER PUBLICATIONS

International Search Report and Written Opinion for PCT/US2013/058431 dated Dec. 16, 2013.

*Primary Examiner* — Patrick M Buechner
(74) *Attorney, Agent, or Firm* — Levenfeld Pearlstein, LLC

(57) ABSTRACT

A fluid dispensing system includes a first fluid supply device for supplying a first fluid, a second fluid supply device for supplying a second fluid, a first heater for heating the first fluid to a first predetermined temperature and a second heater for heating the second fluid to a second predetermined temperature. The dispensing system further includes a nozzle for dispensing the first fluid and the second fluid, the nozzle dispensing the first fluid and the second fluid in intimate contact with one another, the first and second fluids being dispensed at a dispensing temperature, and a nozzle heater, the nozzle heater maintaining the nozzle at a third predetermined temperature independent of the first and/or second predetermined temperatures.

10 Claims, 3 Drawing Sheets

(51) Int. Cl.

| | |
|---|---|
| ***B05C 5/00*** | (2006.01) |
| ***B05C 5/02*** | (2006.01) |
| ***B05C 11/10*** | (2006.01) |
| ***B05C 9/06*** | (2006.01) |
| ***B27G 11/02*** | (2006.01) |
| *B05B 15/02* | (2006.01) |

(52) U.S. Cl.
CPC ..... *B05C 5/0283* (2013.01); *B05C 9/06* (2013.01); *B05C 11/1042* (2013.01); *B27G 11/02* (2013.01); *B05B 15/02* (2013.01)

(56) References Cited

U.S. PATENT DOCUMENTS 3,911,173 A * 10/1975 Sprague, Jr. ..... A43D 25/183 12/142 R
3,942,687 A * 3/1976 Walus ..... B05C 11/1034 222/146.5
4,065,057 A * 12/1977 Durmann ..... B05B 7/1626 239/133
4,589,950 A * 5/1986 Sekavec, Jr. ..... B05C 5/001 118/259
5,342,647 A * 8/1994 Heindel et al. ..... 427/2.31
5,354,378 A * 10/1994 Hauser ..... B05B 7/0861 118/320
5,529,809 A * 6/1996 Glovan et al. ..... 427/422
5,618,566 A * 4/1997 Allen ..... B05C 5/0279 264/12
5,700,322 A * 12/1997 Fort ..... 427/207.1
5,747,102 A * 5/1998 Smith ..... B05C 5/001 222/1
5,882,573 A 3/1999 Kwok et al.
5,902,540 A 5/1999 Kwok
5,904,298 A * 5/1999 Kwok et al. ..... 239/135
6,253,957 B1 * 7/2001 Messerly ..... B05C 5/001 222/1
6,336,801 B1 * 1/2002 Fish ..... D01D 5/0985 425/378.2
7,980,197 B2 * 7/2011 Prentice et al. ..... 118/688
2008/0023489 A1 1/2008 Lessley
2010/0098854 A1 * 4/2010 Bruce ..... C01B 19/002 427/255.7

* cited by examiner

FLUID DISPENSING SYSTEM WITH NOZZLE HEATER

BACKGROUND

The following description relates to a fluid dispensing system, and in particular, a fluid dispensing system having a nozzle heater.

Fluid dispensing systems are used in many industries to, for example, dispense an adhesive or other thermoplastic material onto an item. One such use is in the manufacture of disposable diapers where an adhesive may be dispensed onto an elastic strand for securing the strand to the body of the diaper. Other uses include the application of an adhesive onto a packaging container or carton to seal the carton flaps.

These systems often operate at high speeds to maintain acceptable manufacturing outputs. And, in order to maintain high output, the dispensing nozzles must be maintained at a dispensing temperature to assure that the dispensed material is at a desired temperature.

Current adhesive fiberizing technology uses a combination of actively heated service blocks and air heat exchangers in an attempt to assure the extruded adhesive is at the desired application temperature as it exits the applicator nozzle. The maintenance of nozzle temperature is accomplished via conduction of heat from the glue applicator service block, through the valve module to the nozzle assembly. The air heat exchanger is incorporated into the applicator assembly to further assure nozzle temperatures are maintained by flowing superheated air through the nozzles as the adhesive is applied.

However, reliance upon thermal conduction from the applicator service block, through the module to the nozzle and the use of superheated air is inadequate to maintain the nozzle at the desired application temperature. This shortfall becomes more amplified as the volume of air through the nozzles is increased. The result is that temperatures in excess of 100° F. (38° C.) below the desired set temperature have been observed at the exit point of the nozzle.

This decrease in temperature causes the adhesive to cool as it flows through the valve module and nozzle assemblies. The reduction in adhesive temperatures causes thermal adhesives to thicken, making it more difficult for the adhesives to flow through the nozzle's small passageways. This results in restricted flow through the nozzles, degraded adhesive application patterns and, potentially, plugging of the nozzles, especially after periods of applicator inactivity when the air is flowing through the nozzles and the adhesive has additional time to cool because it is stagnant inside the valve module and nozzle for a protracted time period.

Accordingly, there is a need for a dispensing system that is configured to maintain the temperature of the nozzles, and thus the adhesive, at a minimum desired temperature.

SUMMARY

A fluid dispensing system includes a first fluid supply device for supplying a first fluid and a second fluid supply device for supplying a second fluid. The system also includes a first heater for heating the first fluid to a first predetermined temperature, a second heater for heating the second fluid to a second predetermined temperature, a nozzle for dispensing the first fluid and the second fluids, the nozzle dispensing the first fluid and the second fluid in intimate contact with one another, the first and second fluids being dispensed at a dispensing temperature and a nozzle heater. The nozzle heater maintains the nozzle at a third predetermined temperature independent of the first and/or second predetermined temperatures.

The second heater may be an air heater and the second fluid may be air.

At least one temperature sensor may be provided for sensing the temperature of the nozzle heater. The temperature sensor may transmit a signal to a controller to control the third predetermined temperature. In an exemplary embodiment, the controller maintains the third predetermined temperature at about the dispensing temperature.

The nozzle heater may be positioned in a heater block that is in direct contact with, or close proximity to, the nozzle. The nozzle heater may also include a fastening hole configured to receive a fastener to secure the nozzle heater to the nozzle.

The nozzle may be a plurality of nozzles and the nozzle heater maintains the plurality of nozzles at the third predetermined temperature.

The nozzle heater may be an electrical heater.

The first and second predetermined temperatures may be independent of one another.

The present system uses a direct attachment of an independently-controlled, actively heated device (nozzle heater) that is mounted in direct contact or extremely close proximity to the nozzle. Such a system helps to assure a desired nozzle temperature is maintained to maintain the adhesive at a desired dispensing temperature, and thus prevent or restrict the adhesive from cooling as it flows through a valve module and the nozzle, which can result in restricted flow through the nozzle, degraded adhesive application patterns and potentially plugged nozzles.

Other objects, features, and advantages of the disclosure will be apparent from the following description, taken in conjunction with the accompanying sheets of drawings, wherein like numerals refer to like parts, elements, components, steps, and processes.

DETAILED DESCRIPTION

Figure 1:
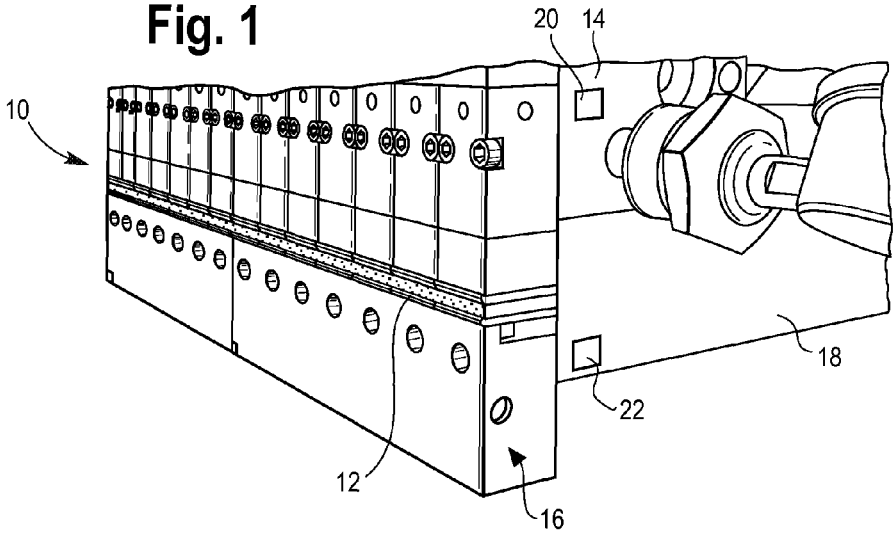
FIG. 1 is a perspective view of an end of a dispensing system according to an exemplary embodiment.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated.

Referring to the figures, a fluid dispensing system is shown generally at 10. FIG. 1 shows a perspective view of the dispensing system 10. Referring to FIG. 1, the dispensing system 10 includes a nozzle 12, a first fluid supply device 14, a nozzle heater 16 and a second fluid supply device 18. In an embodiment, the nozzle 12 is a multiple laminated plate technology (LPT) nozzle 12. The nozzle 12 may be formed as a single nozzle or include multiple nozzles. In addition, the nozzle 12 may be formed on a single segment or include multiple segments.

The nozzle 12 is mounted in fluid communication with the first fluid supply device 14. The first fluid supply device 14 is configured to supply a first fluid to the dispensing system 10 from a pump (not shown). The first fluid is dispensed through the first fluid supply device 14 and the nozzles 12. The first fluid may be an adhesive, thermoplastic, or the like. A first heater 20 (shown schematically) heats and maintains the first fluid at a first predetermined temperature. The first heater 20 may be positioned in or adjacent to the first fluid supply device 14. In an embodiment, the first fluid supply device 14 is a service block.

The nozzle heater 16 is mounted in contact with, or close proximity to, the nozzle 12. In an embodiment, the nozzle heater 16 directly contacts the nozzle 12. The nozzle heater 16 may be directly or indirectly secured to the nozzle 12 or to other adjacent components of the dispensing system 10, for example, the second fluid supply device 18.

The second fluid supply device 18 is positioned adjacent to the nozzle 12 and the first fluid supply device 14. The second fluid supply device 18 is configured to supply a second fluid to the dispensing system 10. A second heater 22 (shown schematically) may be positioned in or adjacent to the second fluid supply device 18 to heat the second fluid to a second predetermined or desired temperature, independent of the first predetermined temperature. The second fluid may be, for example, air. In an exemplary embodiment, the second fluid is heated to a temperature about 60° F. higher than a dispensing temperature. The second fluid supply device 18 supplies the heated second fluid to facilitate flow of the first fluid. In an exemplary embodiment, the second fluid supply device 18 is an air heater assembly and the second heater 22 is an air heater.

Figure 2:
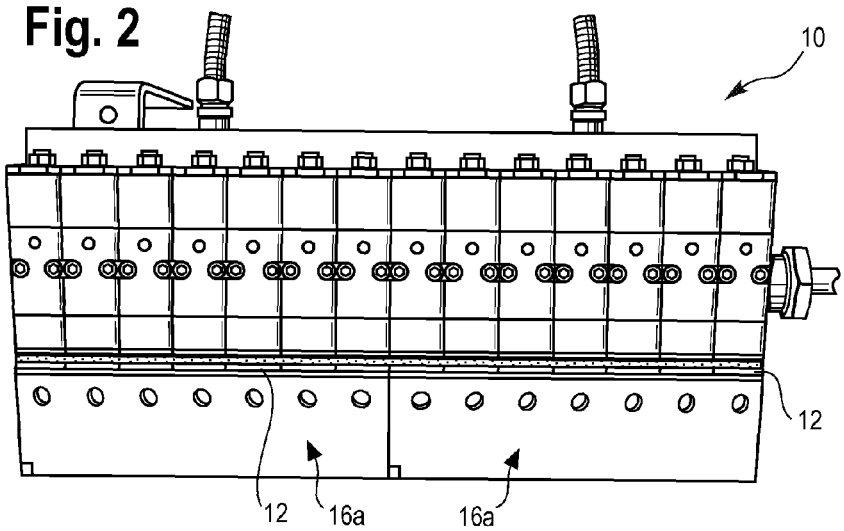
FIG. 2 is a plan view of a lower surface of the dispensing assembly according to an exemplary embodiment.

FIG. 2 is a plan view of a lower surface of the dispensing system 10 according to an embodiment. Referring to FIG. 2, the nozzle heater 16 may include more than one nozzle heater 16, each of which may be are similarly formed and positioned adjacent to one another. That is, one or more nozzle heaters 16 may be mounted and/or positioned adjacent to the nozzle or nozzles 12. The nozzle heater or heaters 16 may be formed as or positioned in a heater block or blocks 16*a* that are positioned in contact or close proximity to the nozzle 12. In an embodiment, the heater block 16*a* directly contacts the nozzle 12. The nozzle heater 16 is configured to supply heat to the nozzle 12 to maintain the nozzle 12 at a third desired or predetermined temperature. In an embodiment, the nozzle heater 16 maintains the nozzle 12 at about the same temperature as the nozzle heater 16.

Figure 3:
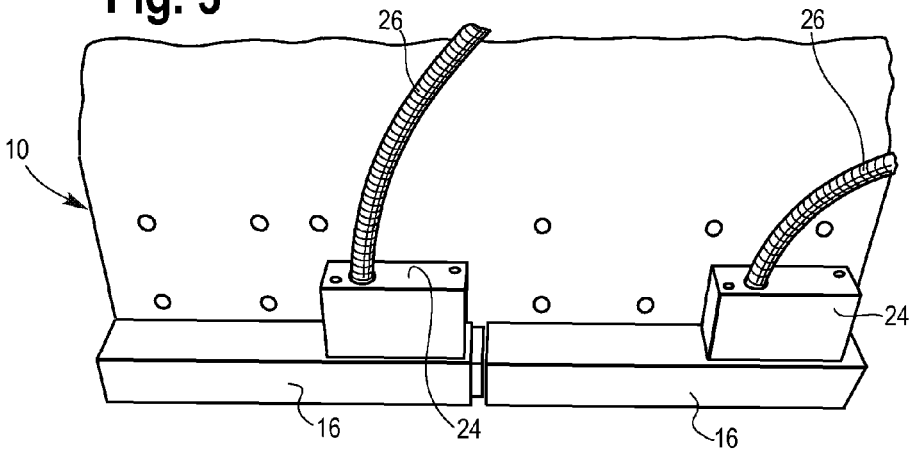
FIG. 3 is a perspective view illustrating a top surface of the dispensing assembly according to an exemplary embodiment.

FIG. 3 is a perspective view of a top surface of the dispensing system 10 according to an embodiment. Referring to FIG. 3, each nozzle heater 16 includes a junction block 24 mounted thereon and a cable assembly 26 extending from the junction block 24. The junction blocks 24 function to route the cable assemblies 26 into respective nozzle heaters 16. The cable assemblies 26 are configured to provide electrical power to the respective nozzle heaters 16.

Figure 4A:
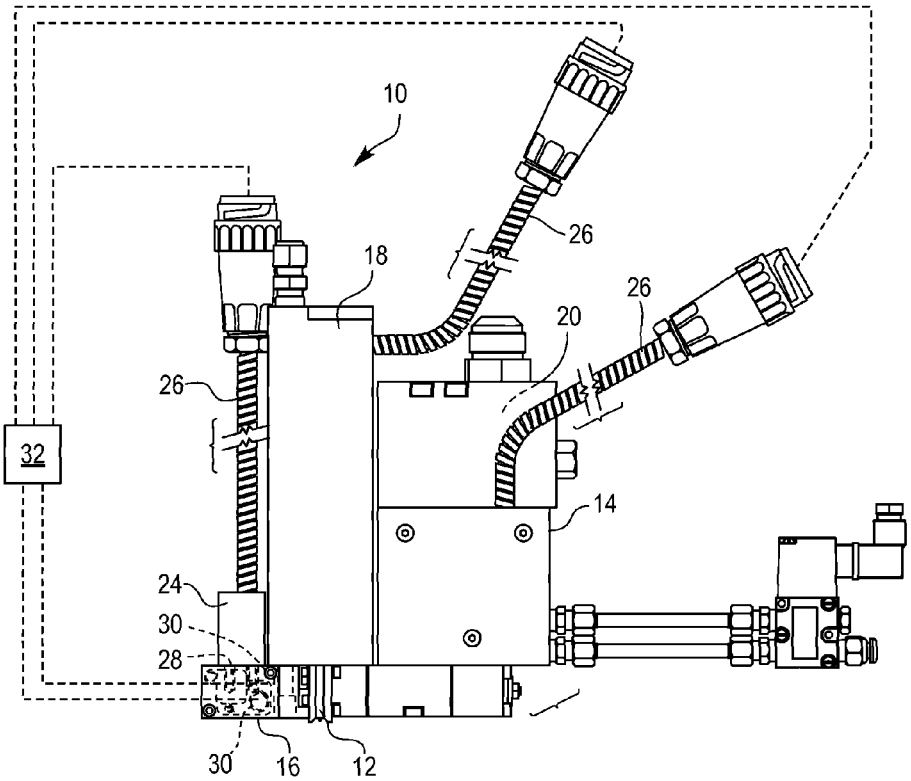
FIGS. 4A and 4B are a side view and a partially exploded side view of the dispensing system according to an exemplary embodiment.
Figure 4B:
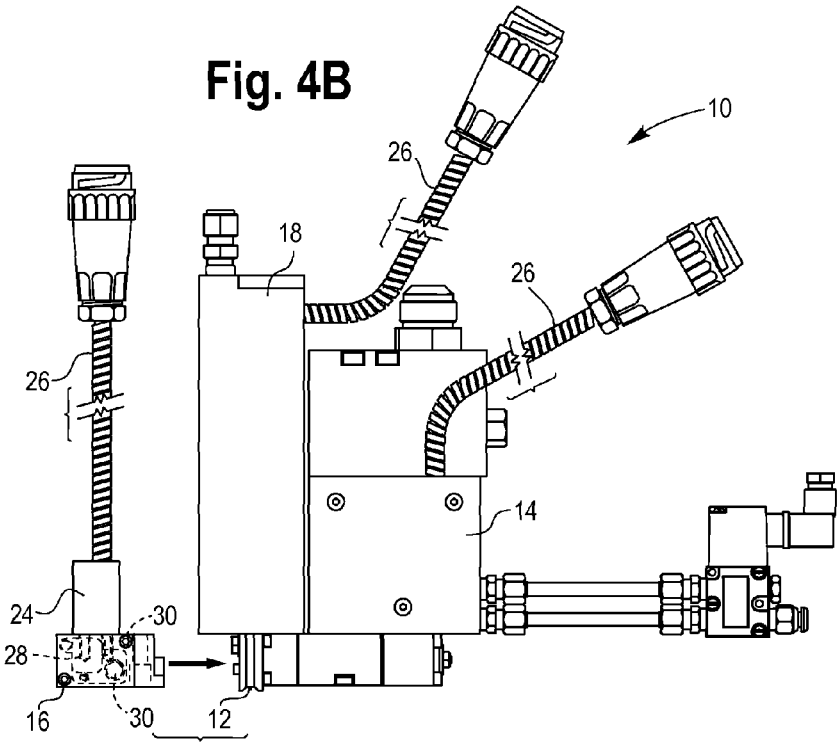

FIGS. 4A and 4B show a side view of the dispensing system 10 and a partially exploded side view of the dispensing system 10, respectively. Referring to FIG. 4A, additional cable assemblies 26 may be operatively connected to the respective first fluid supply device 14 and second fluid supply device 18 to provide power thereto. In an embodiment, the cable assemblies 26 provide power to the first and second heaters 20, 22 of the first fluid supply device 14 and second fluid supply device 18, respectively.

In addition, the nozzle heater 16 includes one or more heating elements 28 to maintain the nozzle heater 16 at the desired or predetermined temperature. In an embodiment, the heating elements 28 are electrical heater elements. Power is supplied to the heating elements 28 via the cable assembly 26. The heating elements 28 can be positioned in the nozzle heater 16 so as to apply heat from the nozzle heater 16 directly to the nozzle 12.

With further reference to FIGS. 4A and 4B, the dispensing assembly 10 may include temperature sensors 30, such as resistance temperature detectors ("RTD5"), thermocouples or the like, and can be located in the nozzle heater 16, the junction block 24 or in other desired locations to monitor and control the temperature at which the nozzle heater 16 is maintained. A controller 32 is operably connected to the temperature sensors 30 and the heating elements 28 to monitor and control the temperature of the nozzle heater 16 to maintain the nozzle heater 16 at the desired or predetermined temperature. That is, the controller may monitor the temperature of the nozzle heater 16 based on information received from the temperature sensors 30, and adjust the temperature of the nozzle heater 16 by controlling the heating elements 28 in response to the information received from the temperature sensors. Accordingly, the controller may maintain the temperature of the nozzle 12 and the third predetermined temperature.

Figure 5A:
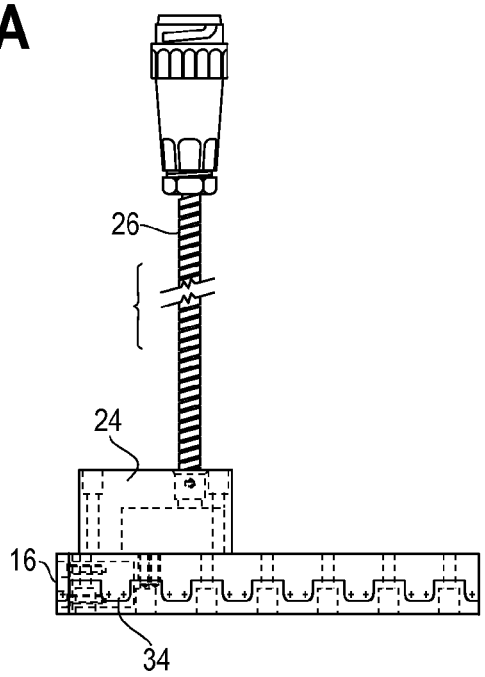
FIGS. 5A and 5B are a front view and a side view of a nozzle heater block according to an exemplary embodiment.
Figure 5B:
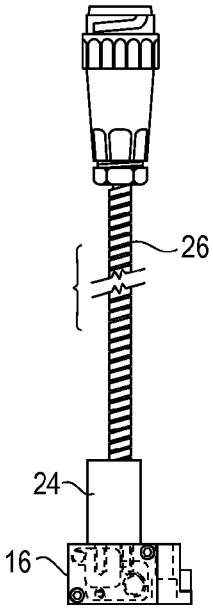

FIGS. 5A and 5B show isolated front and side views, respectively, of the nozzle heater 16 having the junction box 24 and cable assembly 26. The nozzle heater 16 may be configured, as by milling or the like, to permit the nozzle heater 16 to lie on or to abut the nozzle 12. In addition, a face of the nozzle heater 16 facing the nozzle 12 may include fastening holes 34 to receive fasteners, such as screws, bolts, pins or the like, to secure the nozzle heater 16 to the nozzle 12, as shown in FIG. 5A. Thus, in an embodiment, the nozzle heater 16 may be formed together with the junction box 24 and cable assembly 26 and then secured to the dispensing system 10, for example, to the nozzle 12, by way of at least one fastener. It is understood that other suitable fasteners are envisioned to secure the nozzle heater 16 to the nozzle 12, and the embodiments described above are not limited to fasteners that are received in fastening holes of the nozzle heater 16.

In operation, the controller controls the power supplied to the heating elements 28 of the nozzle heater 16. Accordingly, the temperature of the nozzle heater 16 may be maintained at the desired or predetermined temperature. The heating elements 28 are positioned in the nozzle heater 16 so as to directly apply heat to the nozzle 12. Because of the proximity of the nozzle heater 16 to the nozzle 12, the nozzle 12 is maintained at about the same temperature as the nozzle heater 16. It is understood that heating types other than electrical heaters that can be used for direct nozzle 12 heating. It is also understood that single nozzle heater 16 may supply heat to a single nozzle 12 or multiple nozzles 12. In other exemplary embodiments, a plurality of nozzle heaters 16 may supply heat to a single nozzle 12, or alternatively, to plurality of nozzles 12.

In an embodiment of the dispensing system 10, the nozzle heater 16 is maintained at about the dispensing temperature (e.g., 285° F. for polyurethane adhesive) to maintain the nozzle 12 at an elevated temperature to assure that the adhesive remains fluid and does not set up or otherwise interfere with dispensing the first fluid. Other appropriate, desired dispensing temperatures will be appreciated by those skilled in the art. It will also be appreciated that the temperature of the air exiting the second fluid supply device

18 may vary depending upon the desired adhesive, or other fluid, dispensing temperature. The first and second fluids are dispensed from the nozzle 12 in close contact with one another at the dispensing temperature.

The present nozzle heater 16 addresses the problems associated with adhesive or other fluid cooling as it flows through a valve module of the first fluid supply device 14 and nozzle 12. Otherwise, flow of the first fluid or adhesive through the nozzle 12 may be restricted, fluid or adhesive application patterns may be degraded, and, potentially, the nozzle 12 may become plugged, especially after periods of dispensing system 10 inactivity. The present configuration described herein addresses these issues by providing an independently-controlled, actively heated nozzle heater 16 that is mounted in direct contact or in close proximity to the LPT nozzle 12 so that heat may be transferred from the nozzle heater block 16 to the nozzle 12, thereby providing direct and controlled heat at the nozzle 12.

It will be appreciated and understood that although the present nozzle heater 16 is described in connection with LPT nozzles 12 and, in some examples, for use with adhesive dispensing, that the nozzle heater 16 can be adapted for use in a variety of nozzle types and for use with a variety of fluids.

It should also be understood that various changes and modifications to the presently disclosed embodiments will be apparent to those skilled in the art. Such changes and modifications can be made without departing from the spirit and scope of the present disclosure and without diminishing its intended advantages. It is therefore intended that such changes and modifications be covered by the appended claims.

The invention claimed is:

1. A fluid dispensing system comprising:

a first fluid supply device for supplying a first fluid;

a second fluid supply device for supplying a second fluid;

a first heater for heating the first fluid to a first predetermined temperature;

a second heater for heating the second fluid to a second predetermined temperature;

a nozzle having outlets for dispensing the first fluid and the second fluid from the system, the nozzle dispensing the first fluid and the second fluid in intimate contact with one another, the first and second fluids being dispensed at a dispensing temperature, the nozzle comprising a plurality of laminated plates; and a nozzle heater externally positioned on the nozzle in direct contact with an outwardly facing surface of a front plate of the nozzle to apply heat directly to the nozzle, the nozzle heater maintaining the nozzle at a third predetermined temperature independent of the first and/or second predetermined temperatures, wherein the first fluid supply device is positioned in abutting relationship with the second fluid supply device and in non-abutting relationship with the nozzle, and the second fluid supply device is positioned in abutting relationship with the nozzle.

2. The fluid dispensing system of claim 1 wherein the second heater is an air heater and wherein the second fluid is air.

3. The fluid dispensing system of claim 1 including at least one temperature sensor for sensing the temperature of the nozzle heater.

4. The fluid dispensing system of claim 3 including a controller, wherein the temperature sensor transmits a signal to the controller to control the third predetermined temperature.

5. The fluid dispensing system of claim 1 wherein the nozzle heater is positioned in a heater block and wherein the heater block is in direct contact with, or close proximity to, the nozzle.

6. The fluid dispensing system of claim 1 further comprising a controller, wherein the controller maintains the third predetermined temperature at about the dispensing temperature.

7. The fluid dispensing system of claim 1 including a plurality of nozzles and wherein the nozzle heater maintains the plurality of nozzles at the third predetermined temperature.

8. The fluid dispensing system 1 wherein the nozzle heater is an electrical heater.

9. The fluid dispensing system of claim 1 wherein the first and second predetermined temperatures are independent of one another.

10. The fluid dispensing system of claim 1, wherein the nozzle heater includes a fastener hole configured to receive a fastener to secure the nozzle heater to the nozzle.

* * * * *